US005249498A

United States Patent [19]

Wilfer et al.

[11] Patent Number: 5,249,498

[45] Date of Patent: Oct. 5, 1993

[54] NECK ROD MEMBER FOR STRINGED INSTRUMENTS

[75] Inventors: Hans-Peter Wilfer, Erlangen; Walter Zeitler, Röslau, both of Fed. Rep. of Germany

[73] Assignee: Warwick Bass Guitars Inh. Hanspeter Wilfer, Eggolsheim, Fed. Rep. of Germany

[21] Appl. No.: 911,653

[22] Filed: Jul. 10, 1992

[30] Foreign Application Priority Data

Jul. 13, 1991 [DE] Fed. Rep. of Germany ..... 4123319

[51] Int. Cl.[5] ..... G10D 3/00

[52] U.S. Cl. ..... 84/293; 84/267

[58] Field of Search ..... 84/267, 269, 274, 290, 84/293

[56] References Cited

U.S. PATENT DOCUMENTS

| | | | |
|---|---|---|---|
| 3,416,399 | 7/1966 | Baldoni | 84/293 |
| 4,172,405 | 10/1979 | Kaman, II | 84/293 |
| 4,308,780 | 1/1982 | Boucher | 84/293 |
| 4,508,003 | 4/1985 | Smakula | 84/293 |
| 4,681,009 | 7/1987 | Mouradian | 84/293 |
| 4,852,449 | 8/1989 | Zeitler | 84/293 |

*Primary Examiner*—Michael L. Gellner
*Assistant Examiner*—P. Stanzione
*Attorney, Agent, or Firm*—Cohen, Pontani, Lieberman, Pavane

[57] ABSTRACT

A neck rod member for stringed instruments, particularly for a bass guitar, includes two rod portions which extend parallel to each other and are mounted one above the other. The first ends of the rod portions are fixedly connected to each other. An adjustment device is mounted on the second ends of the rod portions for effectively shortening the length of one of the rod portions relative to the effective length of the other of the rod portions, so that a corresponding bending force is imparted on the neck rod member. The adjustment device includes a threaded shaft attached to the second end of one of the rod portions and an adjusting nut mounted with threaded engagement on the threaded shaft. A follower member is mounted on the second end of the other of the rod portions. The follower member is in driving engagement with the adjusting nut in axial direction of the neck rod member.

7 Claims, 3 Drawing Sheets

NECK ROD MEMBER FOR STRINGED INSTRUMENTS

BACKGROUND OF THE INVENTION

1. Field of the Invention

The present invention relates to a neck rod member for stringed instruments, particularly for bass guitars. The rod member includes two oblong rod portions which extend parallel to each other and are arranged one above the other. At one end of the rod member, the rod portions are fixedly connected to each other. At the other free ends of the rod portions, a threaded adjustment means is provided for shortening the effective length of one of the rod portions relative to the effective length of the other of the rod portions, so that the rod member is subjected to a corresponding bending force.

2. Description of the Related Art

A neck rod member of the above-described type is known from U.S. Pat. No. 4,852,449. The threaded adjustment means of this known neck rod member makes it possible to curve the rod member into an arc from its neutral position in which the rod member is straight. Consequently, the neck of the instrument in which the neck rod member is mounted also assumes this arc shape. Accordingly, depending on the existing conditions and requirements, the neck of the instrument can be pulled to assume the shape of an arc, wherein the convex side of the arc faces the strings resting on the finger-board of the neck. The above-described bracing action counteracts the relatively strong tension exerted on the neck of the instrument by the strings. Without this bracing action, the danger exists that the tension of the strings will bend or even break the neck of the instrument.

However, in some stringed instruments, particularly in special types of bass guitars, it may be required, for example, due to the grain of the wood of the neck or for other reasons, that the neck rod member should exert a force on the neck of the instrument which is directed in the same direction as the tension force of the strings. In contrast to the convex arc described above, the neck rod member of U.S. Pat. No. 4,852,449 makes it possible to bend the neck rod member mounted in the neck of the instrument into an arc whose concave side faces the finger-board or the strings of the instrument. In other words, it is possible to use the neck rod member for both types of use, wherein the advantages of loosely inserting the rod member into the blind-end hole of the instrument neck and the loose removal therefrom are maintained.

The operation of the neck rod member according to U.S. Pat. No. 4,852,449 is satisfactory. However, the arrangement of the threaded adjustment means, including two different threaded engagements and corresponding adjusting nuts, is quite complicated.

SUMMARY OF THE INVENTION

Therefore, it is the object of the present invention to provide a neck rod member of the type described above in which the threaded engagement means is simplified as compared to that of U.S. Pat. No. 4,852,449, while maintaining the operational advantages thereof.

In accordance with the present invention, the threaded engagement means includes a threaded shaft and an adjusting nut which is in threaded engagement with the threaded shaft and is arranged at the free end of one of the rod portions and at a follower member at the free end of the other of the rod portions, wherein the follower member is in connection with the adjusting nut, in order to effect movement thereof in longitudinal direction of the neck rod member.

Consequently, the threaded adjustment means according to the present invention is limited to a threaded shaft with only one adjusting nut and a follower member. As a result, the manufacturing costs of the threaded adjustment means are reduced. In addition, the threaded adjustment means requires less space transversely of the longitudinal direction of the neck rod member than is the case in the above-described known neck rod member. This is because only one adjusting nut is provided, not an inner and an outer adjusting nut as is required in the known neck rod member. In this connection, individual details will be discussed hereinbelow.

The neck rod member according to the present invention provides the additional operational advantage that, from a defined neutral position in which none of the two rod portions of the neck rod member has a curvature, the user of the instrument can optionally outwardly curve the one or the other of the rod members merely by turning an adjusting nut in the respective direction, so that the neck rod member has the shape of an arc which is convex or concave relative to the strings of the finger-board.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there is illustrated and described a preferred embodiment of the invention.

DESCRIPTION OF THE PREFERRED EMBODIMENT

Figure 1:
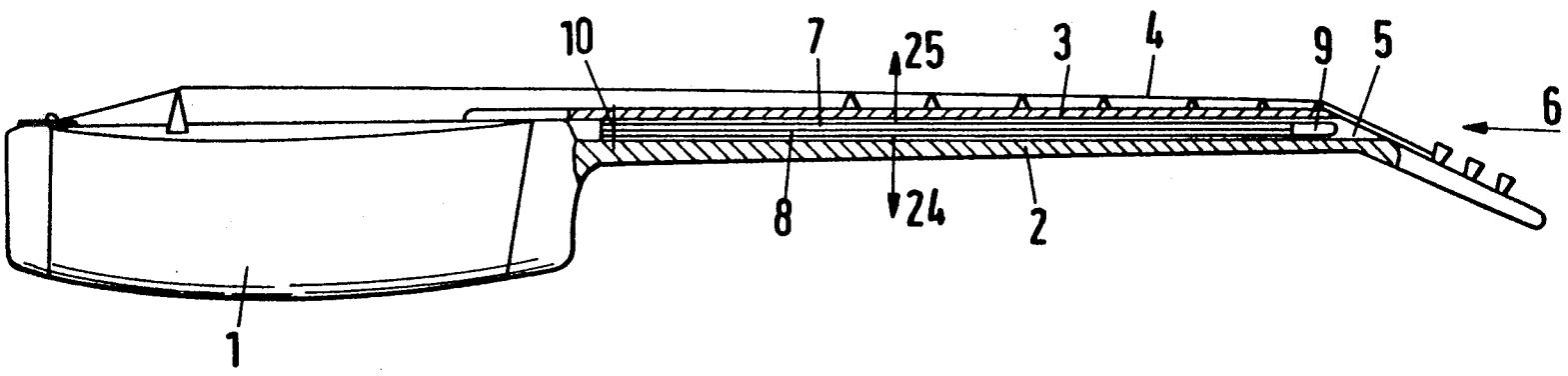
FIG. 1 is a side view, partly sectional, of a stringed instrument with a neck rod member according to the present invention mounted in the neck of the instrument.

FIG. 1 of the drawing shows a stringed instrument, specifically a guitar, with an instrument body 1, a neck 2 with finger-board 3, strings 4 and a blind-end hole 5 which extends parallel to the finger-board 3 in the neck 2. A neck rod member is inserted into the blind-end hole in the direction of arrow 6. The neck rod member can be pulled out of the blind-end hole for repair or replacement opposite the direction of arrow 6. The neck rod member includes a first rod portion 7 and a second rod portion 8, as well as an adjustment means which is only generally denoted by reference numeral 9 in FIG. 1.

Figure 2:
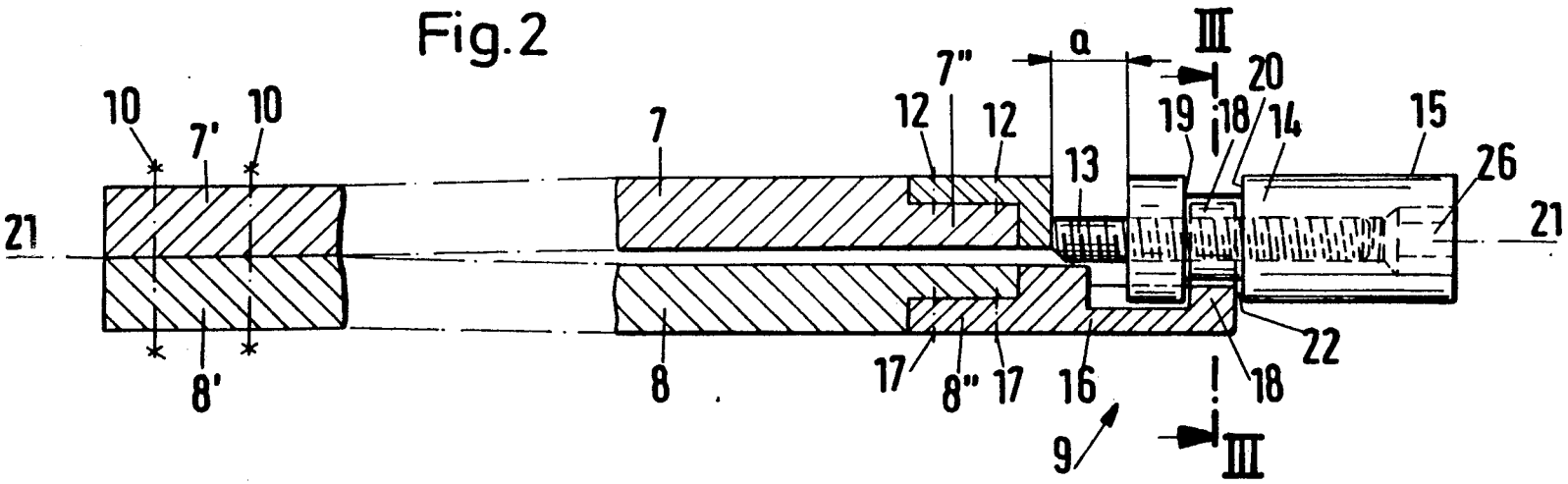
FIG. 2 is a sectional view, on a larger scale, of the neck rod member with the threaded adjustment means.
Figure 3:
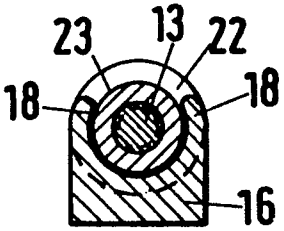
FIG. 3 is a sectional view, taken along sectional line III—III of FIG. 2.

FIGS. 2 and 3 of the drawing show in detail the ends 7' and 8' of rod portions 7, 8 which are fixedly connected to each other by means of rivets 10 or the like. Also shown are the free ends 7'' and 8'' of the rod portions 7, 8 on which the adjustment means is mounted. For this purpose, a support member 11 is fastened by means of rivets 12 to the first rod portion 7 or 7''. A threaded shaft 13 is mounted on the support member 11. An adjusting nut 14 has an internal thread and is screwed by means of this thread onto the thread of the shaft 13. The outer surface 15 of the adjusting nut is constructed and acts as a handle for rotating the adjusting nut.

A follower member 16 is fastened by means of rivets 17 to the feed end 8'' of the second rod member 8. The adjusting nut 14 has two abutments 19, 20 which are spaced apart from each other in longitudinal direction 21—21 of the neck rod member. In the illustrated embodiment, the abutments 19, 20 are the inner walls of a groove 22 of the adjusting nut 14. The follower member 16 has stirrups 18 which extend between the two abutments 19, 20 of the adjusting nut 14. The width of the stirrups 18 is selected such that they engage between the two abutments 19, 20. In other words, the width of the stirrups 18 is only slightly smaller than the distance between the abutments 19, 20. Consequently, a displacement of the adjusting nut 14 due to a rotation thereof is transmitted through the stirrups 18 and the abutment to the second rod member 8. Correspondingly, the displacement is transmitted through the threaded shaft 13 to the first rod member 7. On the other hand, in the circumferential direction of the groove 22, there is no driving engagement or forced transmission between the adjusting nut 14 and the follower member 16 or its stirrups 18.

As can be seen in FIG. 3, the stirrups 18 engage the bottom 23 of the groove 22 along a circumferential angle which is greater than 180°. The stirrups are resilient and can be snapped into the position of operation illustrated in FIGS. 2 and 3. The follower member 16 could also be connected in a different manner to the adjusting nut 14 for a driving engagement in longitudinal direction. For example, an annular member could be provided which completely surrounds the groove or the like of the adjusting nut, however, in this case it is necessary to ensure that it is possible to properly mount the annular member.

Figures 4, 5, 6:
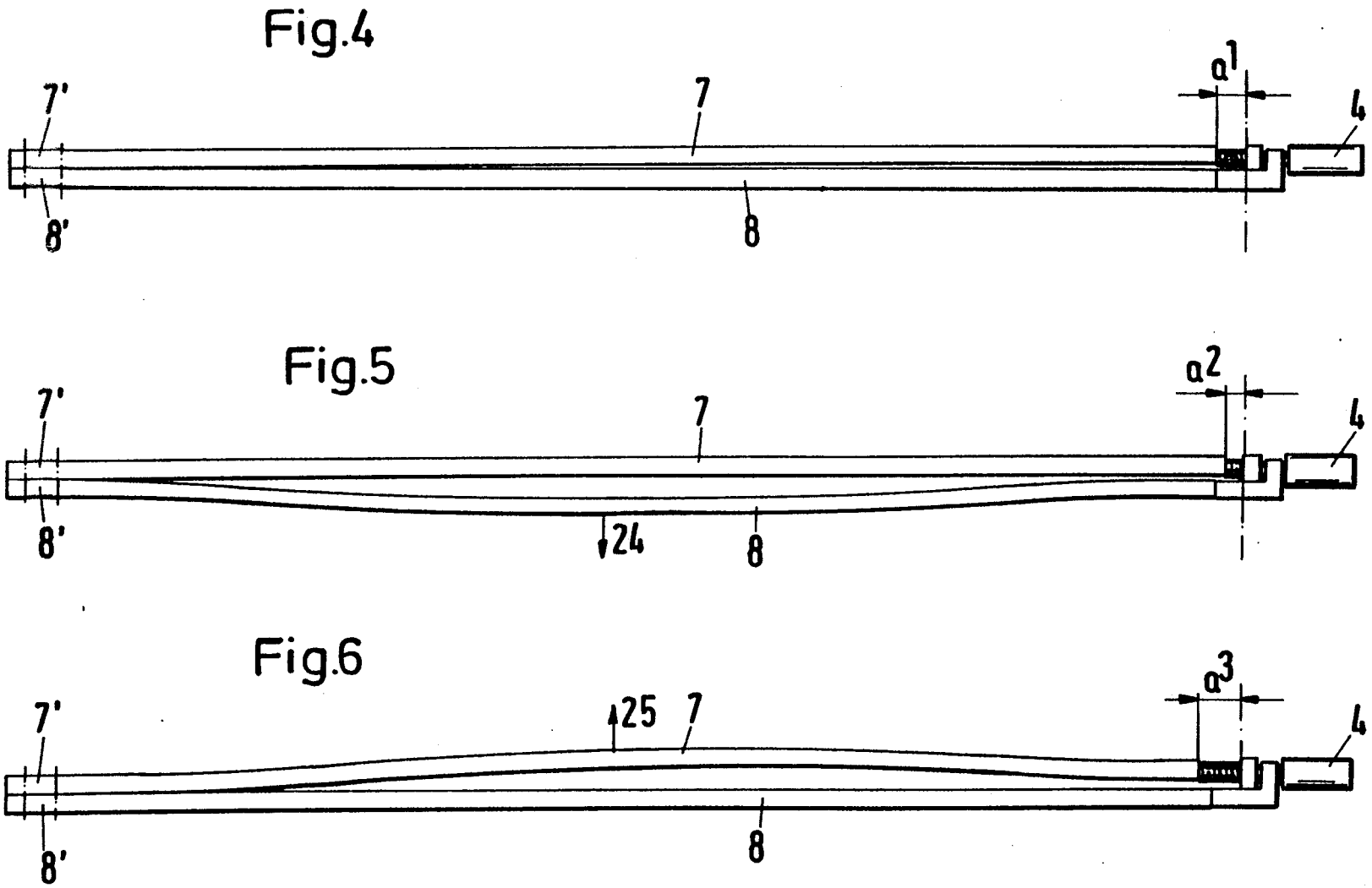
FIGS. 4–6 are schematic side views of the neck rod member showing different positions of adjustment.

FIGS. 4–6 of the drawing are schematic side views showing the different positions of operation or adjustment of the arrangement according to the present invention. In the neutral position shown in FIG. 4, the position of adjustment of the distance a of the adjusting nut 14 from the support member 11 of the threaded shaft 13, as shown in FIG. 2, is equal to the distance $a^1$, such that neither a tensile force nor a compressive force is exerted on the rod members 7 or 8.

In the position shown in FIG. 5, the adjusting nut 14 has been rotated to such an extent that the distance $a^2$ is adjusted, which is smaller than the distance $a^1$. This means that the adjusting nut has pressed the follower members 16, 18 toward the left relative to the threaded shaft 13, as shown in the drawing. However, since the ends 7', 8' of the rod portions are fixedly connected to each other, this means that the effective length of the second rod portion 8 has been reduced because of the compressive force exerted thereon and, because of the movement of the free end 8'' of the second rod portion 8, this rod portion 8 assumes the shape of an arc in the direction of arrow 24.

In the position of adjustment shown in FIG. 6, the adjusting nut 14 has been adjusted in such a way that the distance $a^3$ is adjusted so that it is greater than the distance $a^1$ in the neutral position of FIG. 4. As a result, the free end 7'' of the first arc portion 7 is pressed toward the left as shown in FIG. 6 of the drawing relative to the free end 8'' of the second rod portion 8, so that the effective length of the first rod portion 7 is reduced and, thus, the first rod portion 7 assumes the shape of an arc in the direction of arrow 25.

For carrying out the above-described adjustment procedures, it is recommended that the adjusting nut 14 has at its outwardly directed end a recess 26, as shown in FIG. 2 of the drawing, wherein the contour of the recess 26 is adapted to the outer contour of a socket wrench, for example, square or hexagonal. The socket wrench itself is not illustrated in the drawing.

Accordingly, it is apparent from the above that, by selecting the direction of rotation of the adjusting nut 14 and by selecting the extent of the adjustment, the neck rod member according to the present invention can be subjected to a bending force and can be curved from the neutral position according to FIG. 4 into curved positions in the direction of arrow 24, as well as in the direction of 25, wherein the extent of the curve is determined by the extent of the adjustment. Consequently, as indicated by arrows 24, 25 in FIG. 1, the curvature of the neck rod member results in corresponding forces acting on the neck 2 of the stringed instrument.

The support member 12 of the threaded shaft and also the corresponding end of the follower member 16 are L-shaped in cross section, wherein the sides thereof may be arranged flush with the end face or the upper surface of the ends 7'', 8'' of the rod portions 7, 8.

It should be understood that the preferred embodiments and examples described are for illustrative purposes only and are not to be construed as limiting the scope of the present invention which is properly delineated only in the appended claims.

We claim:

1. A neck rod member adapted for mounting in a neck of a stringed instrument, the neck rod member comprising first and second oblong rod portions extending parallel relative to each other in an axial direction and mounted one on top of the other, the first and second rod portions each having first and second ends, the first ends of the first and second rod portions being fixedly connected to each other, the second ends being movable relative to each other in axial direction, adjustment means being mounted on the second ends of the first and second rod portions for effectively shortening the length of one of the rod portions relative to the other of the rod portions, such that corresponding bending forces are exerted on the neck of the instrument in a direction perpendicular to the axial direction, the adjustment means comprising a threaded shaft extending essentially in axial direction attached to the second end of the first rod portion and an adjusting nut threadedly engaging the threaded shaft, and a follower member attached to the second end of the second rod portion, the follower member being in driving engagement with the adjusting nut in axial direction of the neck rod member.

2. The neck rod member according to claim 1, wherein the adjusting nut comprises two abutments arranged spaced apart in axial direction of the neck rod member, the abutments defining a space therebetween, the follower member having a portion with a width corresponding to the distance between the abutments, the follower member portion engaging in the space between the abutments.

3. The neck rod member according to claim 2, wherein the adjusting nut has a groove with a bottom and with inner walls defining the abutments, the follower member engaging the groove and at least partially surrounding the bottom of the groove.

4. The neck rod member according to claim 1, wherein the follower member is fixedly attached to the second end of the second rod portion, so that, when the adjusting nut is rotated, the follower member slides in circumferential direction relative to the adjusting nut and does not rotate together with the adjusting nut.

5. The neck rod member according to claim 4, wherein the follower member is attached to the second end of the second rod member by means of screws or rivets.

6. The neck rod member according to claim 5, comprising a support member for the threaded shaft attached to the second end of the first rod member by means of screws or rivets.

7. The neck rod member according to claim 6, wherein the support member of the threaded shaft and an end of the follower member fastened to the second rod member are L-shaped in cross section, the second ends of the rod portions being configured such that the L-shaped support member and follower member end are connected flush therewith.

* * * * *